US010351806B2

(12) United States Patent
Oberlin

(10) Patent No.: US 10,351,806 B2
(45) Date of Patent: Jul. 16, 2019

(54) DETERGENT FORMULATIONS WITH LOW WATER CONTENT AND ANTI-REDEPOSITION POLYMERS

(71) Applicant: Dow Global Technologies LLC, Midland, MI (US)

(72) Inventor: Anne Oberlin, Antibes (FR)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 16/068,194

(22) PCT Filed: Feb. 3, 2017

(86) PCT No.: PCT/US2017/016321

§ 371 (c)(1),
(2) Date: Jul. 5, 2018

(87) PCT Pub. No.: WO2017/139184

PCT Pub. Date: Aug. 17, 2017

(65) Prior Publication Data

US 2019/0016995 A1 Jan. 17, 2019

(30) Foreign Application Priority Data

Feb. 12, 2016 (EP) ..... 16290033

(51) Int. Cl.

| | |
|---|---|
| ***C11D 1/00*** | (2006.01) |
| ***C11D 3/37*** | (2006.01) |
| ***C11D 3/00*** | (2006.01) |
| ***C11D 1/14*** | (2006.01) |
| ***C11D 1/72*** | (2006.01) |

(52) U.S. Cl.

CPC ..... *C11D 3/3765* (2013.01); *C11D 1/143* (2013.01); *C11D 1/146* (2013.01); *C11D 1/72* (2013.01); *C11D 3/0036* (2013.01); *C11D 3/3723* (2013.01)

(58) Field of Classification Search

CPC ..... C11D 1/00; C11D 3/37; C11D 3/3707; C11D 3/3746; C11D 3/3765

See application file for complete search history.

(56) References Cited

U.S. PATENT DOCUMENTS

| | | | | |
|---|---|---|---|---|
| 4,797,223 | A | 1/1989 | Amick et al. | |
| 5,503,767 | A | 4/1996 | Schwartz | |
| 6,048,831 | A | 4/2000 | Mori et al. | |
| 2001/0036912 | A1 | 11/2001 | Shulman et al. | |
| 2012/0165242 | A1* | 6/2012 | Ng ..... | C11D 3/3757 510/476 |

FOREIGN PATENT DOCUMENTS

| | | | |
|---|---|---|---|
| WO | 2014/07221 | A1 | 1/2014 |

* cited by examiner

*Primary Examiner* — Brian P Mruk

(57) ABSTRACT

A liquid detergent comprising: (a) from 0 to 30 wt % water; (b) from 60 to 90 wt % surfactants; and (c) from 0.5 to 10 wt % of an acrylic polymer comprising from 20 to 50 wt % polymerized units of (meth)acrylic acid and from 50 to 80 wt % polymerized units of a monomer of structure $H_2C{=}C(R)CO_2(CH_2CH_2O)_n(CH(R')CH_2O)_mR''$; wherein R is H or $CH_3$, R' is $C_1$-$C_2$ alkyl; R'' is $C_8$-$C_{22}$ alkyl or $C_8$-$C_{16}$ alkylphenyl; n is an average number from 6-30 and m is an average number from 0-10, provided that n≥m and m+n is 6-30.

9 Claims, No Drawings

DETERGENT FORMULATIONS WITH LOW WATER CONTENT AND ANTI-REDEPOSITION POLYMERS

This invention relates to low-water detergent formulations, e.g., those enclosed in water-dispersible pouches.

Pouched detergent formulations are known in which a detergent formulation is enclosed in a water-dispersible pouch. Formulations contained in pouches generally have lower water content than other detergent formulations. Acrylic polymers as anti-redeposition additives are known, e.g., in U.S. Pat. No. 4,797,223. However, this reference does not suggest the use of the detergent formulations claimed herein.

The problem solved by this invention is the need for improved pouched cleaning detergent formulations.

STATEMENT OF THE INVENTION

The present invention provides a liquid detergent comprising: (a) from 0 to 30 wt % water; (b) from 60 to 90 wt % surfactants; and (c) from 0.5 to 10 wt % of an acrylic polymer comprising from 20 to 50 wt % polymerized units of (meth)acrylic acid and from 50 to 80 wt % polymerized units of a monomer of structure $H_2C{=}C(R)CO_2(CH_2CH_2O)_n(CH(R')CH_2O)_mR''$; wherein R is H or $CH_3$, R' is $C_1$-$C_2$ alkyl; R" is $C_8$-$C_{22}$ alkyl or $C_8$-$C_{16}$ alkylphenyl; n is an average number from 6-30 and m is an average number from 0-10, provided that n≥m and m+n is 6-30.

DETAILED DESCRIPTION

Percentages are weight percentages (wt %) and temperatures are in ° C., unless specified otherwise. Operations were performed at room temperature (20-25° C.), unless specified otherwise. Weight percentages of components in detergent are based on weights of active ingredients, e.g., surfactant molecules without any water that may be in a commercial surfactant product and on the weight of the entire liquid laundry detergent composition, including water. Percentages of monomer units in the acrylic polymer are based on total weight of the polymer chains, i.e., dry weight. The term "(meth)acrylic" means methacrylic or acrylic. Alkyl groups are saturated hydrocarbyl groups which may be straight or branched. Aralkyl groups are alkyl groups substituted by aryl groups. Examples of aralkyl groups include, e.g., benzyl, 2-phenylethyl and 1-phenylethyl. As used herein the term "surfactant" includes fatty acid soaps.

As used herein, unless otherwise indicated, the phrase "molecular weight" or Mw refers to the weight average molecular weight as measured in a conventional manner with gel permeation chromatography (GPC) and polyacrylic acid standards. GPC techniques are discussed in detail in Modem Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. Molecular weights are reported herein in units of Daltons.

Preferably, the detergent comprises at least 1 wt % of the acrylic polymer, preferably at least 1.5 wt %, preferably at least 2 wt %; preferably no more than 8 wt %, preferably no more than 7 wt %, preferably no more than 6 wt %, preferably no more than 5 wt %.

Preferably, the polymer is an acrylic polymer, i.e., one having at least 60 wt % polymerized residues of acrylic monomers, preferably at least 75 wt %, preferably at least 80 wt %, preferably at least 90 wt %, preferably at least 95 wt %, preferably at least 98 wt %. Acrylic monomers include (meth)acrylic acids and their $C_1$-$C_{22}$ alkyl or hydroxyalkyl esters, including monomers of structure $H_2C{=}C(R)CO_2(CH_2CH_2O)_n(CH(R')CH_2O)_mR''$; crotonic acid, itaconic acid, fumaric acid, maleic acid, maleic anhydride, (meth) acrylamides, (meth)acrylonitrile and alkyl or hydroxyalkyl esters of crotonic acid, itaconic acid, fumaric acid or maleic acid.

Preferably, the acrylic polymer comprises at least 55 wt % polymerized units of a monomer of structure $H_2C{=}C(R)CO_2(CH_2CH_2O)_n(CH(R')CH_2O)_mR''$, preferably at least 60 wt %, preferably at least 65 wt %; preferably no more than 77 wt %, preferably no more than 75 wt %. Preferably, the acrylic polymer comprises at least 23 wt % polymerized units of (meth)acrylic acid, preferably at least 25 wt %; preferably no more than 45 wt %, preferably no more than 40 wt %, preferably no more than 35 wt %.

Preferably, R is H or $CH_3$. Preferably, R' is $CH_3$. Preferably, n is at least 8, preferably at least 10; preferably n is no greater than 25, preferably no greater than 20, preferably no greater than 15. Preferably, m is no greater than 5, preferably no greater than 3, preferably no greater than 1, preferably zero. Preferably, R" is $C_8$-$C_{18}$ alkyl or $C_8$-$C_{16}$ alkylphenyl, preferably $C_8$-$C_{18}$ alkyl, preferably $C_{10}$-$C_{16}$ alkyl. In a preferred embodiment, R" is a mixture of substituents from $C_{10}$-$C_{16}$ alkyl, preferably R" is $C_{12}$-$C_{15}$ alkyl.

Preferably, the weight-average molecular weight (Mw) of the acrylic polymer is from 1,000 to 10,000; preferably at least 1,500; preferably no greater than 7,000, preferably no greater than 5,000, preferably no greater than 4,000, preferably no greater than 3,000.

Preferably, the acrylic acid polymer comprises no more than 0.5 wt % polymerized units of crosslinking monomers, preferably no more than 0.3 wt %, preferably no more than 0.1 wt %, preferably no more than 0.05 wt %, preferably no more than 0.02 wt %. A crosslinking monomer is a multiethylenically unsaturated monomer. Preferably, the detergent formulation comprises no more than 0.5 wt % of a metal ion selected from the group consisting of $Zn^{+2}$, $Ca^{+2}$, $Mg^{+2}$ and $Al^{+3}$, preferably no more than 0.3 wt %, preferably no more than 0.2 wt %, preferably no more than 0.1 wt %. Percentages of metal ions are based on metal alone, without the anion.

Preferably, the detergent comprises at least 65 wt % surfactants, preferably at least 70 wt %, preferably at least 75 wt %; preferably no more than 86 wt %; preferably no more than 83 wt %. Preferably, the detergent comprises at least 3 wt % water, preferably at least 4 wt %, preferably at least 5 wt %, preferably at least 6 wt %, preferably at least 7 wt %; preferably no more than 25 wt %, preferably no more than 20 wt %, preferably no more than 17 wt %, preferably no more than 15 wt %.

The surfactant(s) may be cationic, anionic, nonionic, fatty acid metal salt, zwitterionic or betaine surfactants. Preferably, the formulation comprises at least one anionic surfactant, preferably at least two. Preferably, nonionic surfactants have an alkyl group having at least six carbon atoms and at least five polymerized ethylene oxide or propylene oxide residues. Preferably, nonionic surfactants have at least five polymerized ethylene oxide residues, preferably at least six, preferably at least seven; preferably no more than twelve, preferably no more than eleven, preferably no more than ten. Preferably, anionic surfactants have an alkyl group having at least ten carbon atoms and an anionic group, preferably selected from sulfonates and sulfates. Anionic surfactants also may have polymerized residues of ethylene oxide, and/or may have aromatic rings, e.g., linear alkylbenzene sulfonates. Some anionic surfactants are fatty acid alkali metal salts. Preferably, the detergent composition comprises from 5 to 20 wt % linear alkylbenzene sulfonates, preferably 5 to 15 wt %, preferably 8 to 13 wt %. Preferably, alkylbenzene sulfonates have a $C_{10}$-$C_{14}$ alkyl group. Preferably, the detergent composition comprises at least 2 wt % alkyl sulfates, preferably at least 3 wt %, preferably at least 4 wt %. Preferably, the detergent composition comprises no more than 12 wt % alkyl sulfates, preferably no more than 10 wt %, preferably no more than 8 wt %. Preferably, an alkyl sulfate contains from one to five polymerized ethylene oxide units per molecule.

Preferably, the detergent further comprises from 1 to 15 wt % of a $C_1$-$C_4$ glycol solvent, preferably propylene glycol, preferably from 2 to 10 wt %, preferably from 3 to 8 wt %. Preferably, the detergent further comprises from 1 to 15 wt % of a polyol solvent which is not a $C_1$-$C_4$ glycol, preferably 3 to 12 wt %. Preferred polyol solvents include, e.g., glycerol, tripropylene glycol, polyethylene glycol (preferably less than 4,000,000 Daltons, preferably less than 1,000,000), polypropylene glycol (preferably less than 4,000 Daltons, preferably less than 1,000) and methoxypolyethylene glycol (same preferred molecular weight as for polyethylene glycols).

Preferably, the pH of the detergent composition is from 4 to 11, preferably from 4.5 to 10, preferably from 4.5 to 9. Suitable bases to adjust the pH of the formulation include mineral bases such as sodium hydroxide and potassium hydroxide; ammonium hydroxide; and organic bases such as mono-, di- or tri-ethanolamine; or 2-dimethylamino-2-methyl-1-propanol (DMAMP). Mixtures of bases may be used. Suitable acids to adjust the pH of the aqueous medium include mineral acid such as hydrochloric acid, phosphorus acid, and sulfuric acid; and organic acids such as acetic acid. Mixtures of acids may be used. The formulation may be adjusted to a higher pH with base and then back titrated to the ranges described above with acid.

When builders are present in the compositions of the invention, preferred builders include citrates, phosphates, carbonates, aluminosilicates, organic phosphonates, carboxylates, polycarboxylates (e.g., polyacrylic acid or maleic/(meth)acrylic acid copolymers), polyacetyl carboxylates, or mixtures thereof. The term "carbonate(s)" refers to carbonate, bicarbonate, percarbonate, and/or sesquicarbonate. Builders may be added as salts or in the acid form. Preferably, the carbonates or citrates are sodium, potassium or lithium salts; preferably sodium or potassium; preferably sodium. Preferred builders include sodium carbonate, sodium bicarbonate, sodium citrate, or mixtures of two or more thereof. Preferably, the amount of builder when present in the inventive compositions may range, for instance, from 0.1 to 50 weight %, preferably from 0.5 to 40 weight percent, based on the total weight of the detergent composition.

Co-builders may also be included in the compositions of the invention. Preferred co-builders include, but are not limited to, polyacrylic acid and its copolymers, sulfonates, phosphonates (e.g., sodium diethylenetriamine pentamethylene phosphonate). Preferably, the amount of co-builders, when present in the inventive composition, may range, for instance, from 0.1 to 20 weight %, alternatively from 0.5 to 10 weight percent, based on the total weight of the detergent composition. Builders and co-builders are preferably present in detergent compositions that are automatic dishwashing detergents.

The detergent composition may also comprise various other optional ingredients including, without limitation, hydrotropes (e.g., ethanol, propylene glycol), enzymes (e.g., protease, lipase, amylase), preservatives, perfumes, fluorescent agents, shading dyes, additional builders, and/or additive polymers (e.g., anti-redeposition polymers, anti-greying polymers).

Preferably, the detergent is contained in a sealed package, preferably a unit dose detergent package. Preferably, the package comprises a water-soluble or water-dispersible polymer. In a preferred embodiment of the invention, the polymer is polyvinyl alcohol. Detergent compositions in sealed packages may be used, e.g., in washing machines or automatic dishwashers. Methods for forming pouches are well known and are described, e.g., in WO 2002/060758.

EXAMPLES

Example 1: Performance in a Model Formulation

Model formulation with 11% water coming from anionic surfactants

| Chemistry | Type | % weight (% of active) |
|---|---|---|
| Propylene glycol | Solvent-Hydrotrope | Until 100% (100%) |
| Sodium Lauryl Ether Sulphate[1] | Anionic surfactant | 17.0% (70%) |
| Alkyl alcohol[2] | Non-ionic surfactant | 37.9% (100%) |
| Fatty acid[3] | Soap | 4.3% (100%) |
| Glycerol - Polyol[4] | Hydrotrope | 9.5% (100%) |
| Monoethanolamine[5] | Multifunctional neutralizer | 3.3% (100%) |
| Linear Alkylbenzene Sulfonate[6] | Anionic surfactant | 11.9% (50%) |

[1]EMPICOL ™ ESB 7 from Huntsman ®
[2]ECOSURF ™ SA7 from The Dow Chemical company ®
[3]PALMERA ™ B1220 from KLK Oleo ®
[4]OPTIM ™ from The Dow Chemical company ®
[5]Monoethanolamine from The Dow Chemical company ®
[6]NANSA ™ SS50 from Huntsman ®

The ingredients are added to a beaker under mechanical agitation, following the order of addition described on the chart below. The model formulation is transparent and yellow.

Stability of Post Addition of 3% Active Polymer A, B, C, or D on Top of the Model Formulation Polymers A, B, C and D were post added on top of the model formulation, using a mechanical stirrer at 500 rpm during 5 minutes. The stability of the formulations was assessed visually after 24 h at 22° C. and for the stable formulations; another visual assessment was done after 2 months storage at 40° C.

| Formulation | Stability-visual assessment after 24 h at 22° C. | Stability-visual assessment after 2 months at 40° C. |
|---|---|---|
| Model formulation | Homogenous transparent solution | Homogenous transparent solution |
| Model formulation + 3 wt % | Homogenous transparent | Homogenous transparent |

-continued

| Formulation | Stability-visual assessment after 24 h at 22° C. | Stability-visual assessment after 2 months at 40° C. |
|---|---|---|
| polymer A | solution | solution |
| Model formulation + 3 wt % polymer B | Unstable: phase separation | NA |
| Model formulation + 3 wt % polymer C | Unstable: phase separation | NA |
| Model formulation + 3 wt % polymer D | Unstable: phase separation | NA |
| Model formulation + 3 wt % Benchmark | Homogenous transparent solution | Homogenous transparent solution |

Polymer A = 30% acrylic acid/70% acrylate ester of a 12 mole ethoxylate of a mixed $C_{12}$-$C_{15}$ alcohol, Mw = 2,000; supplied in propylene glycol solution
Polymer B = 27% methacrylic acid/58% ethyl acrylate/15% butyl acrylate, Mw = 40,000; supplied in water solution
Polymer C = 100% acrylic acid, Mw = 4,500; supplied in water solution
Polymer D = 93% acrylic acid/7% stearyl methacrylate, Mw = 6,000; supplied in water solution
Benchmark = ethoxylated polyethylene imine; PEI(600)20EO (SOKALAN ™ HP20 from BASF ®).

Conclusion:

Polymer A was the only acrylic polymer tested which was stable within the model formulation.

Anti Greying Performance (ARD)

The dirt pick up resistance test was performed on European washing machines, from Miele, model Novotronic W1614, set at: 40° C., cotton program, 1000 rpm, water hardness tuned at 30° TH (French hardness degree) and loaded with 3.5 kg ballast fabrics.

The dirt pick up was measured on white fabrics provided by the WFK Company: cotton (Co) reference 10A; polyester-Cotton (65/35) (PeCo) reference 20A.

Each washing machine was loaded with one 21*29.7 cm dimension swatch of cotton, polyester-Cotton (65/35), polyester (Pe) and polyamide 6.6 (PA). One fresh greying swatch provided by WFK Company was added per machine and per cycle. We added 35 g of the Dow model formulation per machine.

After the 10 cycles, the reflectance Y (D65) was measured with a spectrocolorimer Konica Minolta CM2600d on each white swatch (Cotton, polyester-cotton, polyester and polyamide).

To generate the data, the fabrics were folded in the same manner and Y value was measured in two points in one side and two on the other side of each fabric. Then the mean and the standard deviation for each type of fabric were calculated.

| formulation | type of fabrics | % Y (high is better) | stdev |
|---|---|---|---|
| monodose as is | Cotton | 76.35 | 0.47 |
| monodose + 3% w/w Polymer A | Cotton | 77.27 | 0.43 |
| monodose + 6% w/w Polymer A | Cotton | 77.41 | 0.489 |
| monodose + 3% w/w Benchmark | Cotton | 77.54 | 0.54 |
| monodose + 6% w/w Benchmark | Cotton | 77.05 | 0.50 |
| monodose-20% anionic | Cotton | 78.61 | 0.64 |
| monodose-20% anionic + 6% w/w Polymer A | Cotton | 79.10 | 0.49 |
| monodose-20% anionic + 6% w/w Benchmark | Cotton | 76.07 | 0.41 |
| monodose as is | Cotton/Polyester | 81.87 | 0.5 |
| monodose + 3% w/w Polymer A | Cotton/Polyester | 83.22 | 0.4 |
| monodose + 6% w/w Polymer A | Cotton/Polyester | 83.37 | 0.46 |
| monodose + 3% w/w Benchmark | Cotton/Polyester | 82.04 | 0.49 |
| monodose + 6% w/w Benchmark | Cotton/Polyester | 82.81 | 0.43 |
| monodose-20% anionic | Cotton/Polyester | 82.29 | 0.45 |
| monodose-20% anionic + 6% w/w Polymer A | Cotton/Polyester | 84.15 | 0.42 |

-continued

| formulation | type of fabrics | % Y (high is better) | stdev |
|---|---|---|---|
| monodose-20% anionic + 6% w/w Benchmark | Cotton/Polyester | 81.65 | 0.46 |

Conclusions

The addition of Polymer A to the model formulation helped in improving the whiteness of Cotton and Cotton/polyester swatches, compared with no polymer addition. Polymer A provides the same of whiteness, dosed at either at 1.5% or 3% w/w of the model formulation.

The addition of Polymer A allows 20% reduction of anionic surfactant while increasing the % Y vs. no polymer for both Cotton and Cotton/polyester swatches. Polymer A performs either at the same level of the benchmark, either its offers superior performance on cotton and cotton polyester fabrics when the amount of anionic surfactants is reduced by 20%.

Primary Cleaning Performance

The primary cleaning performance test was performed on European washing machines, from Miele, model NOVOTRONIC W1614, set at: 40° C., cotton program, 1000 rpm, water hardness tuned at 30° TH and loaded with 3.5 kg ballast fabrics. The primary cleaning performance test was measured after 1 wash cycle on stains on cotton provided by CFT Company: such as Grass, Morello concentrate pure; Tomato Ketchup and Clay.

Each washing machine was loaded with ballast fabric and stains. We ran 6 replicas per stain. We dosed 35 g of the Dow model formulation per machine (see example 1 for model composition).

The primary cleaning is measured via Delta E (ΔE) of each stain. Delta E is the color difference between the unwashed stain and the washed stain, within the L*a*b* color space. Each stain was measured, before and after wash. Delta E of each stain was calculated from the L*a*b* values of unwashed and washed stain, following the following equation:

$$\Delta E=\sqrt{((L^*_{unwashed}-L^*_{washed})^2+(a^*_{unwashed}-a^*_{washed})^2+(b^*_{unwashed}-b^*_{washed})^2)}$$

When Delta E is high, the primary cleaning is also important.

Then the mean and the average standard deviation (st dev) for each type of fabric were calculated.

| Formulations | C-H016 Grass | | C-H023 Morello | | C-H036 Tomato | | C-H155 Clay | |
|---|---|---|---|---|---|---|---|---|
| | Delta E avg | st dev avg | Delta E avg | st dev avg | Delta E avg | st dev avg | Delta E avg | st dev avg |
| model | 17 | 0.6 | 44.5 | 1.2 | 32.1 | 1.7 | 21 | 2.2 |
| model + 3% polymer A | 18.5 | 3.3 | 45.9 | 2.2 | 34.5 | 2.2 | 24.2 | 1.8 |
| model + 3% benchmark | 16.8 | 1.8 | 44.1 | 3.3 | 33.7 | 2.2 | 23.8 | 2 |
| model − 10% anionic surfactant + 3% Polymer A | 20.5 | 3.5 | 52.2 | 9.5 | 37 | 3 | 27.4 | 3.1 |
| model − 10% anionic surfactant + 3% Benchmark | 16.4 | 2 | 43.2 | 2.7 | 33.2 | 2.4 | 20.6 | 2.2 |
| model − 20% anionic surfactant + 3% Polymer A | 20.5 | 4.9 | 57.2 | 9.8 | 35.3 | 3.5 | 27.1 | 4.3 |

Conclusions

The addition of Polymer A to the Dow model formulation helps to improve the primary cleaning performance of some stains. The addition of Polymer A allows 10% to 20% reduction of anionic surfactant while improving the primary cleaning vs. no polymer. Some stains such as tomato and clay were significantly washed better with a 10% reduction of anionic surfactant and 3% Polymer A. Morello stain washed with a 20% reduction of anionic surfactant and 3% Polymer A is washed better.

Polymer A performs either at the same level of the benchmark, either its offers superior performance on cotton fabrics when the monodose is reduced by 10% and even 20% anionic surfactants.

Stability within a Commercially Available Hydrosoluble Film:

The design of the unit dose packaging was performed following this procedure. First, a PVC tube of about 3 cm diameter has been tested for its resilience to heat. The source of heat used was a flat iron tuned with the highest temperature and no steam production. After 10 seconds the tube was intact.

Then, 2 pieces of the polyvinyl alcohol film were put together and the temperature of the flat iron was fine-tuned until the 2 pieces were welded. This temperature was then fixed for the next steps. Afterwards, the tube was wrapped with the hydro soluble film until the 2 parts were in contact. The hydro soluble film is welded with the edge of the flat iron to obtain a tube, a form a sort of bag. The obtained bag was then filled with detergent formulation and the other end could be welded.

Dow monodose formulations with and without Polymer A, have been tested with the commercially available polyvinyl alcohol hydro soluble film. The unit dose in its packaging was stored at room temperature for 2 months and no damage has been visually observed on the hydro soluble film.

Conclusion

The unit dose formulation and the hydro soluble packaging are compatible. Furthermore the unit dose containing Polymer A, the most promising prototype successfully passed this compatibility test.

Example 2: Performance on a Heavy Duty Laundry (HDL) Model Formulation

HDL Model Formulation

| Chemistry | Type | % in mass (% of active) | 20% reduction anionic surfactant |
|---|---|---|---|
| water | Solvent | 30% (100%) | 30% (100%) |
| Linear Alkylbenzene Sulfonate[1] | Anionic surfactant | 17.8% (80%) | 16% (=−10%) (80%) |
| Alkyl alcohol[2] | Non-ionic surfactant | 8.25% (100%) | 8.25% (100%) |
| Propylene glycol[3] | Solvent-Hydrotrope | 5% (100%) | 5% (100%) |
| Na Citrate[4] | builder | 2% (100%) | 2% (100%) |
| Fatty acid[5] | Soap | 6.4% (100%) | 6.4% (100%) |
| ethanol[6] | Solvent-Hydrotrope | 2% (100%) | 2% (100%) |
| Sodium Xylenesulfonate[7] | hydrotrope | 6.33% (30%) | 5.7% (=−10%) (30%) |
| Polymer A | acrylic polymer | 6% or 3% (50%) | 6% or 3% (50%) |
| NaOH | neutralizer | To pH 8.5 | To pH 8.5 |
| water | Solvent | To 100% | To 100% |

[1]NANSA ™ HS 80 from Huntsman Inc.
[2]ECOSURF ™ EH 6 from The Dow Chemical Company
[3]Propylene glycol from The Dow Chemical Company
[4]trisodium citrate, dehydrate from Merck Inc.
[5]PALMERA ™ B1220 from KLK Oleo
[6]Ethanol from Merck Inc.
[7]ELTESOL ™ SX 30 from Huntsman Inc.

Anti Greying Performance (ARD)

The dirt pick up resistance test was performed on European washing machines, from Miele, model Novotronic W1614, set at: 40° C., cotton program, 1000 rpm, water hardness tuned at 30° TH and loaded with 3.5 kg ballast fabrics.

The dirt pick up was measured on white fabrics provided by WFK Company: cotton (Co) reference 10A; polyester-Cotton (65/35) (PeCo) reference 20A; polyester (Pe) reference 30A and polyamide 6.6 (PA) reference 40A.

Each washing machine was loaded with one 21*29.7 cm dimension swatch of cotton, polyester-Cotton (65/35), polyester (Pe) and polyamide 6.6 (PA). One fresh greying swatch provided by WFK Company was added per machine and per cycle. Dow HDL model formulation was dosed at 65 g per machine.

After the 10 cycles, the reflectance Y (D65) was measured with the spectrocolorimer Konica Minolta CM2600d on each white swatch (Cotton, polyester-cotton, polyester and polyamide). To generate the data, the fabrics were folded in the same manner and Y value was measured in two points in one side and two on the other side of each fabric. Then the mean and the standard deviation for each type of fabric were calculated.

| formulations | Type of fabrics | % Y average Average (100% is best) | Stdev |
|---|---|---|---|
| HDL | Cotton | 74.23 | 0.87 |
| HDL + 3% active Polymer A | Cotton | 77.18 | 0.32 |
| HDL + 1.5% active Polymer A | Cotton | 76.62 | 0.52 |
| HDL + 3% active Benchmark | Cotton | 77.54 | 0.27 |
| HDL + 1.5% active Benchmark | Cotton | 75.97 | 0.60 |
| HDL-20% anionic surfactant | Cotton | 74.36 | 0.63 |
| HDL-20% anionic + 3% active Polymer A | Cotton | 77.72 | 0.92 |
| HDL-20% anionic + 3% active Benchmark | Cotton | 75.48 | 0.43 |
| HDL | Pe/Co | 77.34 | 2.06 |
| HDL + 3% active Polymer A | Pe/Co | 78.37 | 1.53 |
| HDL + 1.5% active Polymer A | Pe/Co | 78.42 | 0.34 |
| HDL + 3% active Benchmark | Pe/Co | 77.68 | 1.28 |
| HDL + 1.5% active Benchmark | Pe/Co | 76.57 | 0.54 |
| HDL-20% anionic surfactant | Pe/Co | 76.60 | 1.96 |
| HDL-20% anionic + 3% active Polymer A | Pe/Co | 79.40 | 0.44 |
| HDL-20% anionic + 3% active Benchmark | Pe/Co | 78.02 | 1.11 |

Conclusions

The addition of Polymer A to HDL model formulation helps in improving the whiteness on Cotton and Cotton/polyester swatches, compared with no polymer addition. Polymer A provides the same of whiteness, dosed at either at 1.5% or 3% w/w of the monodose model formulation.

The addition of Polymer A allows 20% reduction of anionic surfactant while increasing the % Y vs. no polymer for both Cotton and Cotton/polyester swatches. Polymer A performs either at the same level of the benchmark, either its offers superior performance on cotton fabrics when the HDL is reduced by 20% anionic surfactants.

The invention claimed is:

1. A liquid detergent comprising: (a) from 0 to 30 wt % water; (b) from 60 to 90 wt % surfactants; and (c) from 0.5 to 10 wt % of an acrylic polymer comprising from 20 to 50 wt % polymerized units of (meth)acrylic acid and from 50 to 80 wt % polymerized units of a monomer of structure $H_2C{=}C(R)CO_2(CH_2CH_2O)_n(CH(R')CH_2O)_mR''$; wherein R is H or $CH_3$, R' is $C_1$-$C_2$ alkyl; R" is $C_8$-$C_{22}$ alkyl or $C_8$-$C_{16}$ alkylphenyl; n is an average number from 6-30 and m is an average number from 0-10, provided that n≥m and m+n is 6-30.

2. The detergent of claim 1 in which R" is $C_8$-$C_{18}$ alkyl and n is from 8 to 20.

3. The detergent of claim 2 in which the acrylic polymer has no more than 0.1 wt % crosslinker.

4. The detergent of claim 3 comprising from 1 to 8 wt % of an acrylic polymer.

5. The detergent of claim 4 comprising from 0 to 20 wt % water.

6. The detergent of claim 5 comprising from 65 to 86 wt % surfactants.

7. The detergent of claim 6 in which the acrylic polymer comprises from 23 to 40 wt % polymerized units of (meth) acrylic acid and from 60 to 77 wt % polymerized units of a monomer of structure $H_2C{=}C(R)CO_2(CH_2CH_2O)_n(CH(R')CH_2O)_mR''$.

8. The detergent of claim 6 in which m is no greater than one and R' is methyl.

9. The detergent of claim 8 comprising from 3 to 17 wt % water.

* * * * *